US008833537B2

(12) United States Patent
Kashiwabuchi et al.

(10) Patent No.: US 8,833,537 B2
(45) Date of Patent: Sep. 16, 2014

(54) MEDIUM STOCKING APPARATUS

(75) Inventors: Masashi Kashiwabuchi, Gunma (JP); Kei Iwatsuki, Gunma (JP); Michio Suetaka, Saitama (JP); Naoki Hata, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/991,162

(22) PCT Filed: Apr. 18, 2012

(86) PCT No.: PCT/JP2012/060483

§ 371 (c)(1),
(2), (4) Date: May 31, 2013

(87) PCT Pub. No.: WO2013/014985

PCT Pub. Date: Jan. 31, 2013

(65) Prior Publication Data

US 2013/0240321 A1 Sep. 19, 2013

(30) Foreign Application Priority Data

Jul. 25, 2011 (JP) ..... 2011-162420

(51) Int. Cl.

| | |
|---|---|
| ***G07F 7/04*** | (2006.01) |
| ***B65H 27/00*** | (2006.01) |
| ***G07D 11/00*** | (2006.01) |
| ***B65H 5/28*** | (2006.01) |
| ***B65H 29/00*** | (2006.01) |

(52) U.S. Cl.

CPC ..... *G07D 11/0021* (2013.01); *B65H 5/28* (2013.01); *B65H 29/006* (2013.01); *B65H 2402/441* (2013.01); *B65H 2701/1912* (2013.01); *G07D 11/0081* (2013.01); *B65H 2301/41912* (2013.01); *B65H 2402/64* (2013.01); *B65H 2601/321* (2013.01)

USPC ..... 194/206; 312/34.1; 221/71

(58) Field of Classification Search

CPC ..... G07F 7/04; B65H 2404/2614; B65H 2404/2615

USPC ..... 194/206, 344, 350; 242/398, 410, 528; 235/379; 209/534; 312/34.1; 271/3.21, 271/275; 221/71

See application file for complete search history.

(56) References Cited

U.S. PATENT DOCUMENTS

| | | | | |
|---|---|---|---|---|
| 2010/0163571 | A1* | 7/2010 | Mizoro | 221/71 |
| 2011/0198192 | A1 | 8/2011 | Togiya et al. | |
| 2012/0103754 | A1* | 5/2012 | Robinson et al. | 194/206 |

FOREIGN PATENT DOCUMENTS

| | | | |
|---|---|---|---|
| JP | 9-315647 | | 12/1997 |
| JP | 2006-069708 | A | 3/2006 |
| JP | 2011-002921 | A | 1/2011 |
| WO | 2009/050796 | A1 | 4/2009 |

* cited by examiner

*Primary Examiner* — Mark Beauchaine
(74) *Attorney, Agent, or Firm* — Rabin & Berdo, P.C.

(57) ABSTRACT

A medium stocking apparatus includes a housing having an open area, reels on which tapes are wound, a diverting unit for turning backward the tapes, a cylindrical drum on which a medium is wound with the tapes overlaid, and an openable unit for closing and opening an internal space from and to outside. During an operation, a closed state can be retained, and, during a maintenance work, an open state can be achieved, in which the openable unit is rotated in an upward direction for displacing upper tapes. The medium stocking apparatus can thus be offered which allows a maintenance work with high workability without impairing the tapes.

8 Claims, 10 Drawing Sheets

MEDIUM STOCKING APPARATUS

TECHNICAL FIELD

The present invention relates to a medium stocking apparatus, which is preferably applied to an automated teller machine (ATM) for putting media such as bills into the machine to conduct a desired transaction.

BACKGROUND ART

Consumer transaction facilities, e.g. automated teller machines, have been used in, e.g. financial institutions to carry out transactions with customers, e.g. transactions of depositing cash, namely bills and coins, or withdrawing cash by a customer.

Japanese patent laid-open publication No. 2011-2921 offers an automated teller machine, which includes a bill slot for giving and receiving bills to and from a customer, a validator for determining the denominations and authenticity of bills deposited in the machine, a temporary holding section for temporarily holding deposited bills, and denomination-sorted cassettes for stocking bills sorted by denominations. In the automated teller machine, when the customer inserts bills into the bill slot of the automated teller machine, the validator distinguishes the deposited bills, and the temporary holding section temporarily stores the bills when the bills are determined as authentic ones, whereas bills considered as being inappropriate are returned to the bill slot to give them back to the customer. Subsequently in the automated teller machine, the customer fixes the amount of money to be deposited, and the validator in turn determines again the denominations of the bills stored in the temporary holding section to store the bills in the denomination-sorted cassettes according to the denominations thus determined.

In a conventional automated teller machine, a temporary holding section is configured such that an upper tape is drawn from an upper reel and is turned back by an upper tape pulley, and a lower tape is drawn from a lower reel and turned back by a certain pulley. The upper and lower tapes thus turned back hold conveyed bills in between with the shorter-side direction thereof aligned to sequentially wrap the bills on a cylindrical drum, whereby a number of bills are stored in the housing of the temporary holding section.

Correspondingly, the upper and lower tapes are respectively wrapped on the upper and lower reels, and the drum is rotated in a direction opposite to the direction for storing bills to thereby discharge the stored bills.

With the above configuration, there is a possibility that a damaged bill is torn off and a chip of the bill (hereafter called as stub) gets into an unintended place in the housing of the temporary holding section, or that a lot of bills is wrapped around the drum, which becomes increasing its diameter, and as a consequence the drum comes into contact with a movable guide so as to be disabled to rotate to discharge bills.

In such a case, a maintenance work by a serviceperson may have to be implemented in such a way that he or she removes the bill or stub from the housing of the temporary holding section by checking with his/her eyes or by approaching the inside of the housing (hereinafter referred to as access) with his/her fingers or any tools. Such a maintenance work is troublesome because the movable guide cannot widely be opened up due to the structure in which the upper tape runs over the movable guide. In order to facilitate the maintenance work, a side part of the temporary holding section would be designed to be openable, but in that case, another problem might arise that, when the bill sandwiched between the upper and lower tapes is drawn out, the tapes may be drawn out together with the bill or the tapes may be torn off.

In this way, the temporary holding section has a drawback in maintenance workability due to the presence of the movable guide and the upper tape.

SUMMARY OF THE INVENTION

It is an object of the present invention to provide a medium stocking apparatus that enhances the maintenance workability.

In accordance with the present invention, a medium stocking apparatus is configured to include a receiving section receiving a transaction of a generally rectangular and sheet-like, a conveyance section conveying the medium received by the receiving section, a housing forming an internal space surrounded by a partition and having an open area where a part of the partition is eliminated, a reel on which a tape is wound which has a width narrower than a long side of the medium, a diverting unit arranged for diverting the tape drawn out from the reel and thereafter running across the open area, a cylindrical drum disposed rotatably in the internal space in the housing for winding thereon the tape diverted by the diverting unit with the medium, when fed from outside of the housing in its narrow-side direction, overlaid on the tape, a winding guide blocking up the open area between the internal space and the outside for guiding the tape and the medium diverted by the diverting unit along a running path toward a circumferential surface of the drum, and an openable unit constituting apart of the winding guide for closing and opening the open area between the internal space and the outside and decreasing an extent that the tape drawn from the reel and running across the open area in an open state in comparison with that in a closed state.

The present invention can provide the medium stocking apparatus that blocks up, during a normal operation, the open area of the wrapping guide to protect the internal space of the housing, and opens, during the maintenance work, the open area to form a passage between the internal and outer spaces while lessening the tape obstruction in the open area, thereby facilitating the serviceperson in visual inspection on, and access to, the internal space.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
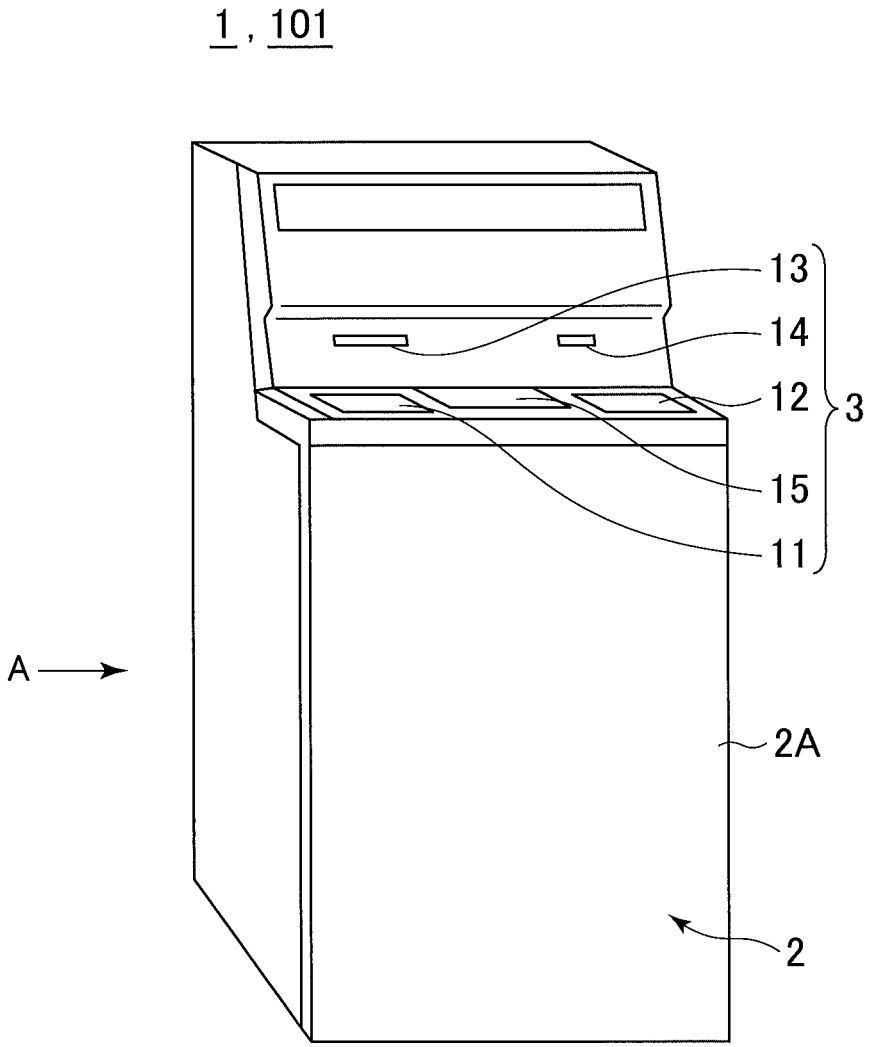
FIG. 1 is a schematic perspective view showing the appearance of an automated teller machine in accordance with a preferred embodiment of the present invention.

With reference to the accompanying drawings, the entire structure of a medium stocking apparatus according to a first embodiment of the present invention will be described in detail. As shown in FIG. 1, an automated teller machine 1 is elementally constructed by a housing 2 to be served to conduct cash transactions with customers. The housing 2 is provided with a customer service section 3 in an area convenient for the customer standing in front of the machine to insert bills into the machine and operate its touch panel, i.e. an area across from the upper part of its foreside 2A to its top side.

The customer service section 3 is designed to directly handle cash, a bankbook and the like for the customer as well as imparting information on a transaction and receiving operational instructions, and is provided with a coin slot 11, a bill slot 12, a bankbook slot 13, a card slot 14 and a display console 15.

The coin slot 11 and the bill slot 12 are adapted for receiving coins and bills the customer deposits and discharging coins and bills he or she withdraws. The coin slot 11 and the bill slot 12 can be opened and closed by respective shutters provided thereto to be driven. Bills, which may often be folded during the course of distribution, are made typically of rectangular sheets of paper, and may be inserted into the machine without being unfolded.

The bankbook slot 13 is adapted to receive a bankbook for use in transaction and eject the bankbook when the transaction is finished. The bankbook slot 13 has in its back a bankbook processing unit, not shown, for recording transaction details on the bankbook.

The card slot 14 is adapted for receiving and ejecting various types of cards, such as bank cards. The card slot 14 has in its back a card processing unit, not shown, for reading an account number and the like, which are magnetically or electrically recorded on the cards.

The display console 15 is configured by a liquid crystal display (LCD) for displaying an operation screen during transaction and a touch panel integrated therewith for selecting transaction types and inputting data desired or required to a selected transaction, e.g. a personal identification number and a transaction amount of money.

Figure 2:
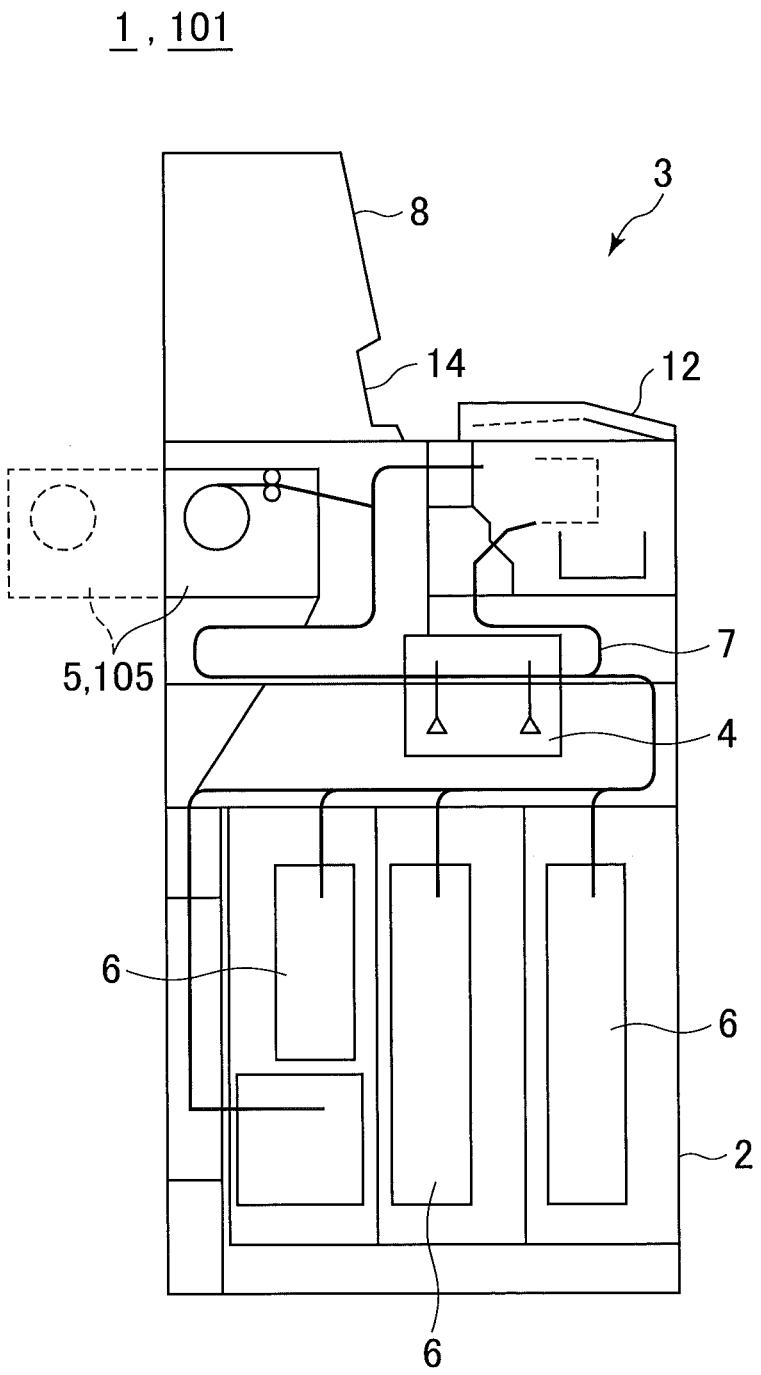
FIG. 2 is a schematic perspective side view showing the structure of the automated teller machine in the preferred embodiment illustrated in FIG. 1.

FIG. 2 is a perspective side view, viewed in the direction of allow A, of the automated teller machine 1 according to the embodiment shown in FIG. 1, the figure presenting part of the internal structure directly pertaining to the processing of bills. As shown in the figure, the automated teller machine 1 has on its upper portion the bill slot 12, a validator 4 for determining about the denomination and authenticity of bills and a temporary holding section 5 for temporarily holding deposited bills, and on the lower portion a bill storage 6 consisting of denomination-sorted cassettes. The automated teller machine further includes conveyance paths 7 for conveying bills between the aforementioned elements in the shorter-side direction thereof and a control section 8 for generally controlling over the automated teller machine 1.

The control section 8 is adapted to conduct a control such that, when the customer deposits bills in a deposit transaction, a specific input operation is received on the display console 15 to in turn open the shutter of the bill slot 12 to wait for bills to be inserted, and bills, when inserted, are conveyed over the conveyance paths 7 to the validator 4, which in turn determine the authenticity of the bills, so that bills, which determined as authenticated, are conveyed to the temporary holding section 5 to temporarily hold them whereas bills determined as unacceptable are conveyed to the bill slot 12 to return them to the customer. The control section 8 further conducts a control such as to prompt the customer to fix the deposit amount on the display console 15, and then convey bills held in the temporary holding section 5 back to the validator 4 to determine the denominations of the bills to convey and store the bills in the denomination-sorted cassettes of the bill storage 6 according to the denominations.

The housing 2 has such that part of at least one of the ends of the foreside 2A and the side opposite thereto, i.e. backside, is formed into an openable door, not shown. As illustrated in FIGS. 1 and 2, the doors are closed off prior to the customer operating transactions on cash so that bills stored in the bill storage 6 can be protected, and when a serviceperson carries out a maintenance work the doors are opened up as necessary to thereby facilitate the maintenance work on the inside components.

The automated teller machine 1 may be configured such that the door on the backside end is opened during the maintenance work to slide out the temporary holding section 5 by means of a slide mechanism toward the backside as indicated with a dashed line in FIG. 2 and the upper surface of the temporary holding section 5 thus slid out is tilted up to the backside.

Figure 3:
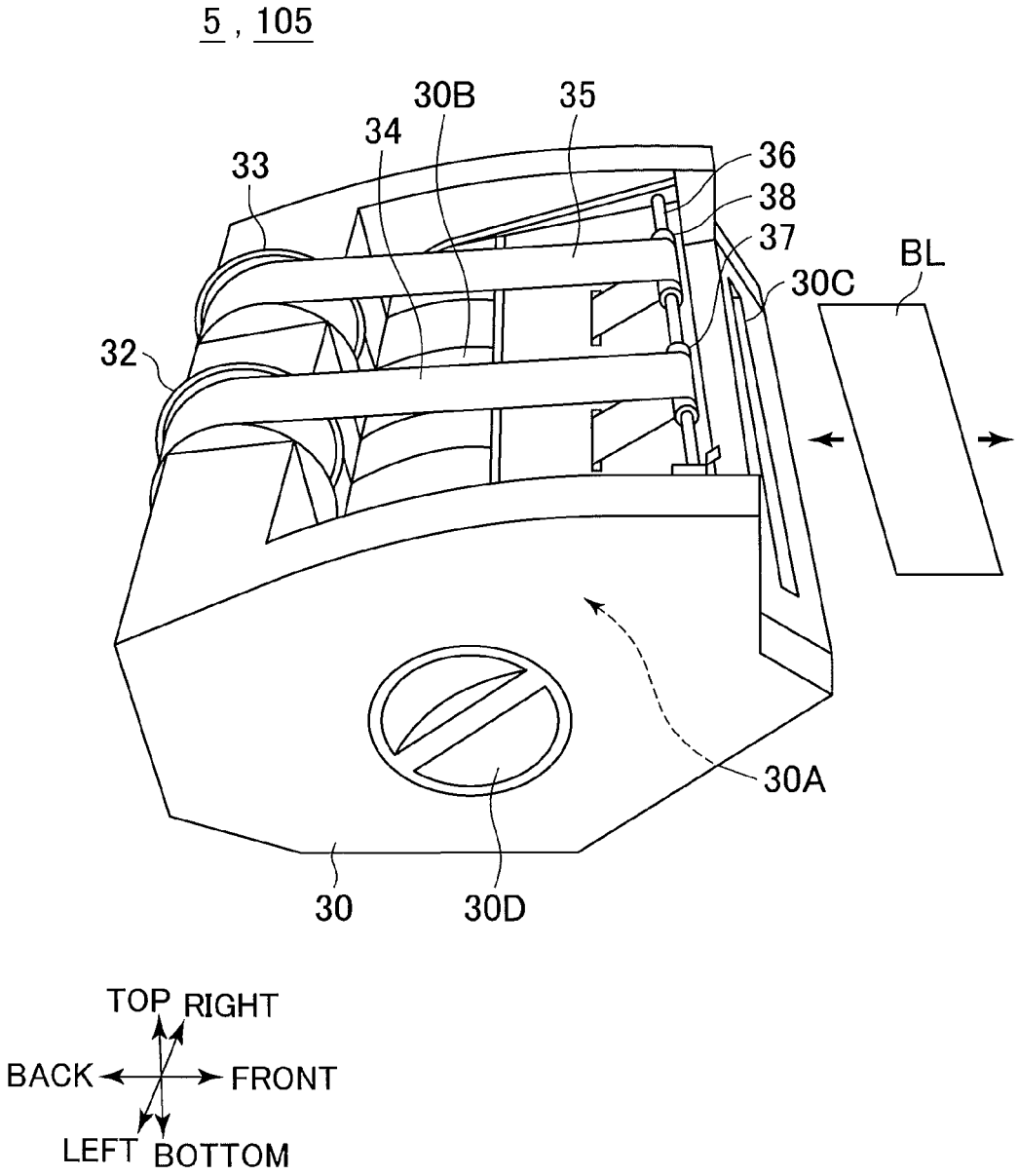
FIG. 3 is a schematic perspective view showing the external structure of a temporary holding section in the preferred embodiment illustrated in FIG. 2.

Now, the configuration of the temporary holding section 5 will be described by referring to FIG. 3. As shown in FIG. 3, the temporary holding section 5 includes a temporary holding housing 30 as well as upper reels 32 and 33, a pulley shaft 36, upper tape pulleys 37 and 38 and upper tapes 34 and 35 fixed on the former.

In addition, the temporary holding housing 30 has an internal space 30A formed by partitions utilizing the most of its outer circumference, i.e. the foreside where bills are inserted, the backside opposite to the foreside, the left and right sides with respect to the foreside, and the lower side which is the bottom of the housing. By contrast, the housing 30 has on its upper side an open area 30B which allows the access to the internal space 30A from the outside.

In addition, the surface of the foreside of the temporary holding housing 30 has is a bill insert/draw-out port 30C cut through which bills are inserted into and drawn out from the internal space 30A.

In the inner areas of the right and left partitions of the temporary holding housing 30, a transmission system is built-in which consists of, e.g. gears, not shown, for transmitting driving force from a motor to a drum or rollers, as will be described later. Moreover, the left surface of the housing 30 is provided with an operating knob 30D for rotating the drum or rollers by hand during the maintenance work.

Figure 4:
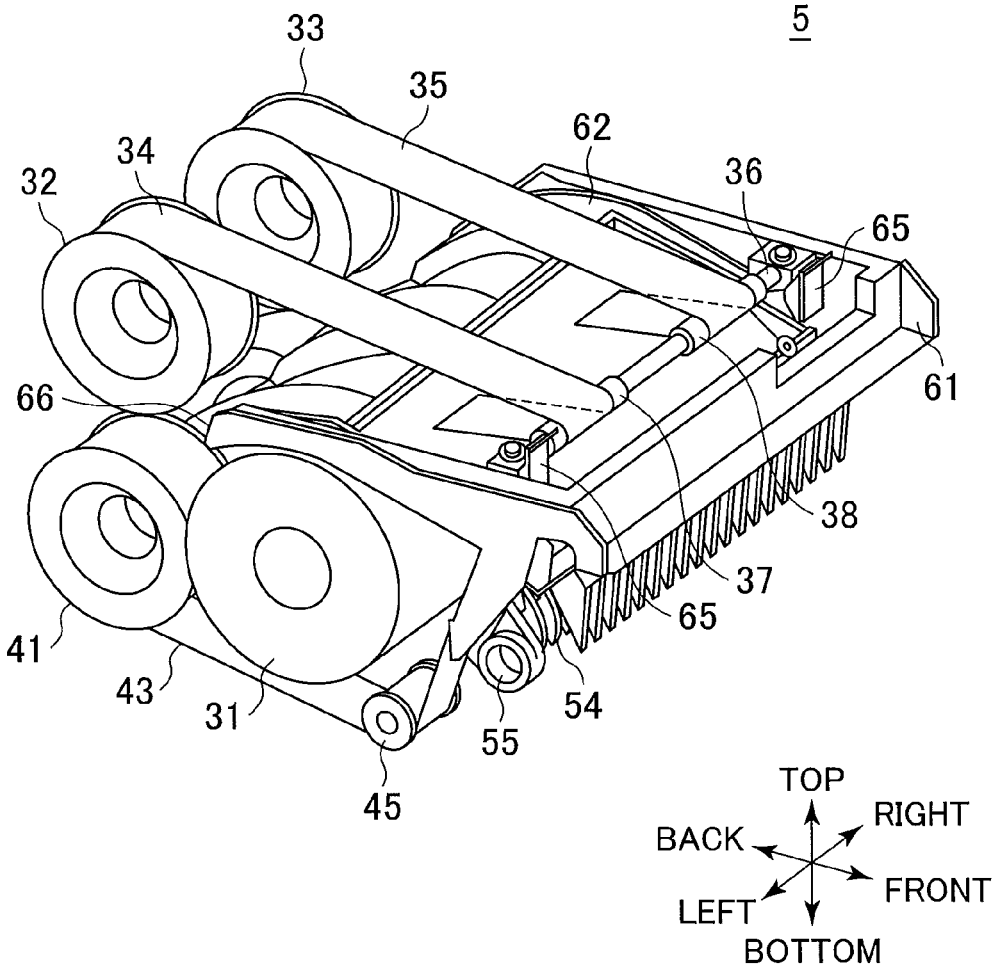
FIG. 4 is a schematic perspective view showing the appearance of the internal mechanism of the temporary holding section in the preferred embodiment illustrated in FIG. 3.
Figure 5:
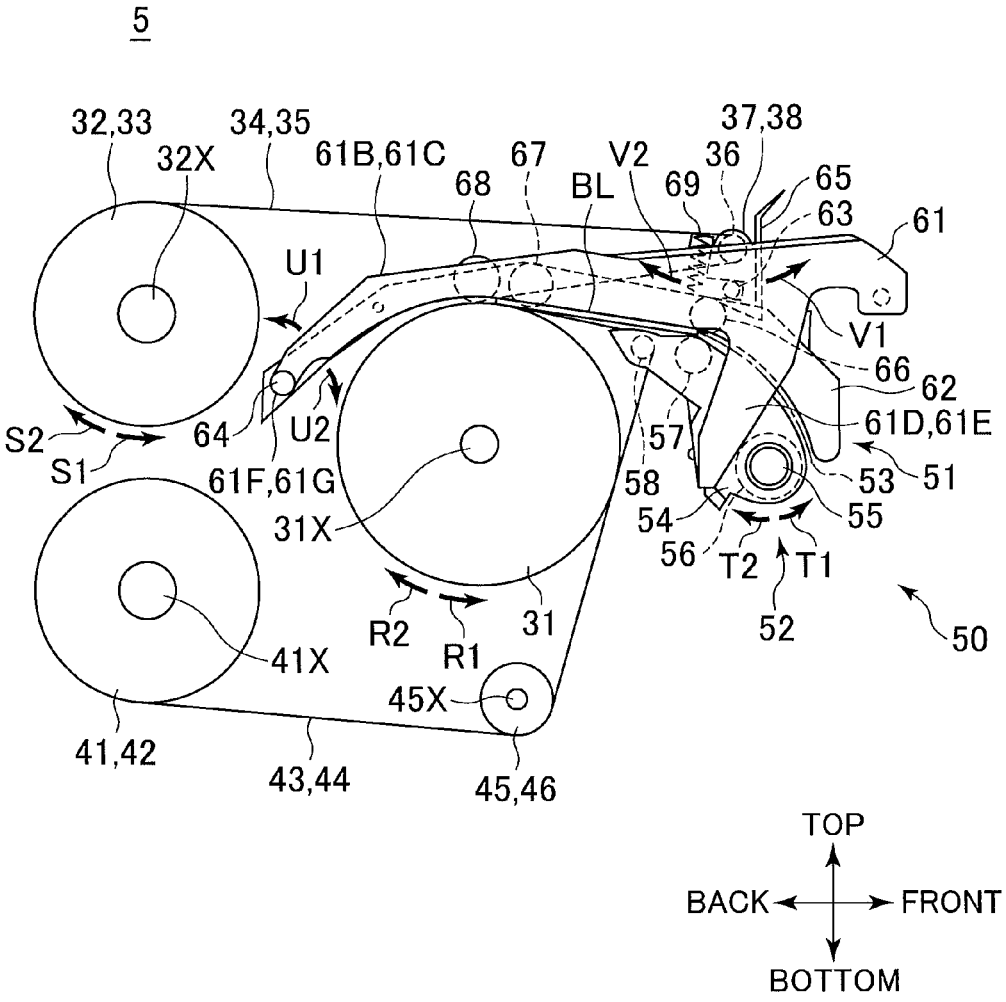
FIG. 5 is a schematic side view showing the internal structure of the temporary holding section in the preferred embodiment illustrated in FIG. 3.

FIG. 4 is a perspective view illustrating the appearance of the internal structure of the temporary holding section 5, from which the temporary holding housing 30 is omitted, and FIG. 5 is a side view showing the internal structure of the temporary holding section 5 shown in FIG. 4. As shown in FIG. 4, the temporary holding section 5 further includes a drum 31, lower reels 41 and 42, lower tapes 43 and 44, and lower tape pulleys 45 and 46.

The drum 31 has a cylindrical structure and is fitted rotatably about a lateral rotation axis 31X in a winding direction R1 or an unwinding direction R2 in the internal space 30A, FIG. 3, of the temporary holding housing 30.

The temporary holding section 5 is also provided with tape running systems, which are similar in structure, on the respective sides of the section 5. Each tape running system is configured to run an upper and a lower tape in synchronous.

The upper reels 32 and 33 are arranged in spool above the drum 31, i.e. at positions approximately symmetric with each other on the left-lay and right-lay and a little bit to the backward on the open area 30B side, FIG. 3, so as to rotate about a rotation axis 32X which is parallel to the rotation axis 31X of the drum 31. On the upper reels 32 and 33, the upper tapes 34 and 35 are wound, respectively.

The upper tapes 34 and 35 are made of thin film resin, of which the width is sufficiently narrower than the long side of a bill BL, FIG. 3, and the length is sufficiently longer than the narrow side of the bill BL.

The upper tape pulleys 37 and 38 are in cylindrical form with a pulley shaft 36 parallel to the rotation axis 31X of the drum being inset as a revolvable rotary shaft, and are disposed toward the front of the drum 31, i.e. on the side of the bill insert/draw-out port 30C, FIG. 3.

Furthermore, the upper tape pulleys 37 and 38 are longer in the lateral direction than the width of the upper tapes 34 and 35, and fixed on the pulley shaft 36 to be positioned in the lateral direction correspondingly to the respective upper reels 32 and 33.

As shown in FIG. 5, the upper tapes 34 and 35 are drawn out from the upper reels 32 and 33, respectively, to pass across the open area 30B, FIG. 3, in the anterior direction, and are then wound on the upper tape pulleys 37 and 38 to return backward.

The upper tapes 34 and 35 are also pressed against the drum 31 by means of a conveyance roller 68 arranged on an upper guide base 62. As noted, the upper tapes 34 and 35 have the end parts thereof secured on the drum 31.

The upper reels 32 and 33 are biased by a tension spring, not shown, in the respective winding directions S1 of the upper tapes 34 and 35, and the upper tapes 34 and 35 are thereby constantly under a predetermined tension.

The upper reels 32 and 33 are purposely disposed slightly posterior to the drum 31, and the upper tapes 34 and 35 run forward from the upper reels 32 and 33 to the upper tape pulleys 37 and 38 and turned back on the upper tape pulleys 37 and 38. That allows the temporary holding section 5 to avoid the interference of the upper reels 32 and 33 with the rest of the mechanism of the automated teller machine 1. Moreover, as will be described later, in the vicinity of the drum 31, the upper tapes 34 and 35 can run from front to back.

The lower reels 41 and 42 are configured in spool as with the case of the upper reels 32 and 33 and arranged below the upper reels 32 and 33, i.e. at positions approximately symmetric with each other on the left-lay and right-lay and a little bit to the backward below the drum 31 so as to rotate about a rotation axis 41X which is parallel to the rotation axis 31X of the drum 31. On the lower reels 41 and 42, the lower tapes 43 and 44 structured similarly to the upper tapes 34 and 35 are respectively wound in the direction opposed to the winding direction of the upper tapes 34 and 35.

The lower tapes 43 and 44 are made of thin film resin as is the case with the upper tapes 34 and 35, and the tape width is sufficiently narrower than the long side of the bill BL and the length is sufficiently longer than the narrow side of the bill BL.

The lower tape pulleys 45 and 46 are in cylindrical form, as is the case with the upper tape pulleys 37 and 38, and are located anterior to the lower reels 41 and 42, respectively, rotatably about a rotation axis 45X which is parallel to the rotation axis 31X of the drum 31.

In addition, the lower tape pulleys 45 and 46 have a lateral length longer than the width of the lower tapes 43 and 44, and are disposed at positions corresponding to the lower reels 41 and 42 in the lateral direction.

As shown in FIG. 5, the lower tapes 43 and 44 are respectively drawn out from the lower reels 41 and 42, pass forward and are wound on the lower tape pulleys 45 and 46, and then pass upward. The lower tapes 43 and 44 further pass backward and are pressed against the drum 31 by means of a roller attached to a movable lower guide 52, as will be described later. The lower tapes 43 and 44 the end parts thereof secured on the drum 31.

As in the case of the upper reels 32 and 33, the lower reels 41 and 42 are disposed slightly posterior to the drum 31, thereby allowing the temporary holding section 5 to avoid the interference with the rest of the mechanism of the automated teller machine 1.

The lower tape 43 has its end part fixed at a position on the left-lay of the circumferential surface of the drum 31 whereas the upper tape 34 has its end part fixed on the circumferential surface of the drum 31 in such a fashion that the upper tape overlaps with the outer circumference of the lower tape 43. Correspondingly, the lower tape 44 has its end part fixed at a position on the right-lay of the circumferential surface of the drum 31, i.e. a position approximately symmetric with the position of the lower tape 43 whereas the upper tape 35 has its end part fixed on the circumferential surface of the drum 31 to overlap with the outer circumference of the lower tape 44.

With the above configuration, when the drum 31 is rotated in the winding direction R1, the lower and upper tapes 43 and 34 are wound on top of another on the circumferential surface of the drum 31 while the lower and upper tapes 44 and 35 are wound on top of another on the circumferential surface.

If bills BL are fed in the above case, the temporary holding section 5 can hold the bills between the lower tapes 43, 44 and the upper tapes 34, 35 to wrap the bills BL together with the lower tapes 43, 44 and the upper tapes 34, 35 on the circumferential surface of the drum 31.

Next, a description will be made on the movable guide 50. The movable guide 50 consists of a movable upper guide 51 arranged on the upper part of the guide 50 and a movable lower guide 52 arranged on the lower part of the guide 50. Between the movable upper and lower guides 51 and 52, a gap is provided which is sufficiently wider than the thickness of the bills BL, and formed in the gap is a conveyance path 53 for conveying the bills BL along the undersurface of the upper guide 51.

The lower guide 52 is primarily composed of a lower guide base 54 formed into a generally drop or wedge shape, viewed from the lateral side. On the under and front side of the lower guide base 54, a rotation bore 55 is formed to penetrate in the lateral direction. In addition, the temporary holding housing 30, FIG. 3, is provided on its right and left internal surfaces with a rotation axis, not shown, inserted in the rotation bore 55 in the lateral direction, and the movable lower guide 52 can thereby rotate about the rotation axis as well as the rotation bore 55 in an inward direction T1 or outward direction T2 with respect to the temporary holding housing 30, as shown in FIG. 5.

Furthermore, the lower guide base 54 is provided on its curved oblique plane lying between the front and upper sides of the guide base with conveyance rollers 56 and 57 which expose their front and upper parts from the oblique plane. The conveyance rollers 56 and 57 are formed in a cylindrical shape and have a respective rotation axis, not shown, extending in the lateral direction so that, when driving force is transmitted via a drive mechanism, not shown, the rollers 56 and 57 can rotate together with the rotation axis in either direction.

On the upper part of the rear end of the lower guide base 54, a cylindrical lower tape roller 58 is fitted in such a way that the roller 58 can rotate about its rotation axis extending in the lateral direction, not shown. The lower tape roller 58 allows the lower tapes 43 and 44 running upward to turn around and go backward along the conveyance path 53 under an upper guide base 62, which will be described later.

The movable guide 50 thus structured allows bills BL, when inserted from the front side into the conveyance path 53, are sequentially sent by the rotating conveyance rollers 56 and 57 toward the back on the conveyance path 53, and then by the lower tapes 43 and 44 which run backward from the lower tape roller 58 further toward the back.

The movable upper guide 51 mainly consists of a frame 61 and the upper guide base 62 such that the frame 61 is fastened to the lower guide base 54 and the upper guide base 62 is positioned by the frame 61 so as to cover the drum 31 and the upper part of the lower guide base 54.

Figure 6:
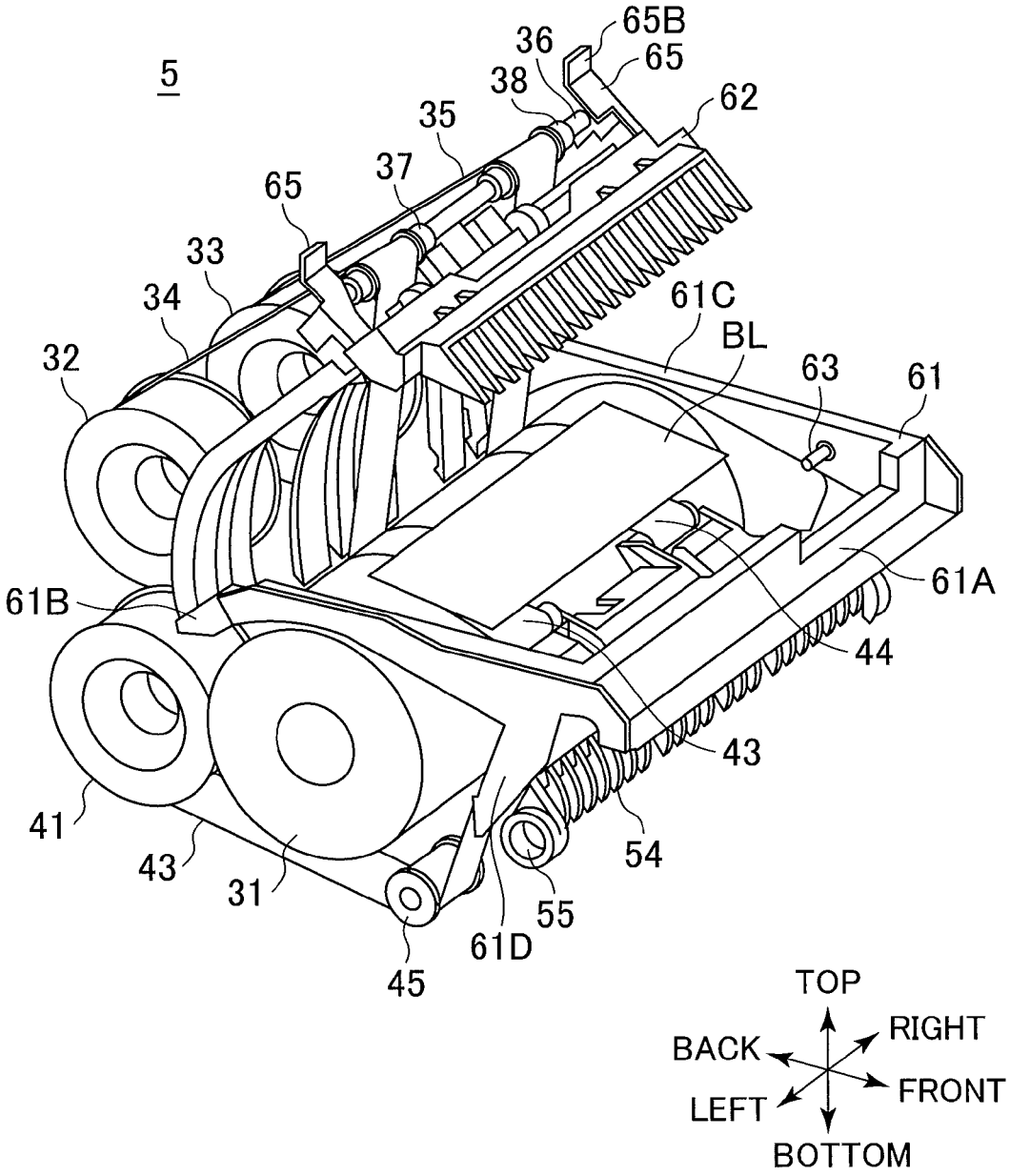
FIG. 6 is a schematic external perspective view showing the preferred embodiment shown in FIG. 4 when its movable upper guide is raised.

The frame 61 is provided with, as shown in FIG. 6, a left and a right arm 61B and 61C, which extend backward from the respective left and right ends of an anterior part 61A which elongates in the lateral direction on the front side of the frame 61.

The rear parts of the left and right arms 61B and 61C are formed in an arch curving down to the rear end so as to generally follow the contour of the drum 31. In addition, from the parts close to the front of the left and right arms 61B and 61C, respective coupling legs 61D and 61E extend downward.

The frame 61 is fixed at the downside of the coupling legs 61D and 61E on the lower guide base 54 so as to rotate together with the movable lower guide 52 when the movable lower guide 52 rotates about the rotation bore 55.

The left and right arms 61B and 61C have the respective inner surfaces, close to the front sides, provided with a cylindrical lock post 63 which projects inward.

Moreover, in the vicinity of the rear ends of the left and right arms 61B and 61*c*, retraction holes 61F and 61G are formed to penetrate through the respective arms in the lateral direction, and inserted into the retraction holes 61F and 61G is a retraction shaft 64 having a cylindrical shape in the lateral direction.

The upper guide base 62 is arranged such as to be surrounded on its front, right and left sides by the frame 61 and cover the tope of the open area 30B formed on the upper side of the temporary holding housing 30, FIG. 3. The guide base 62 has its undersurface shaped such that the front portion, which covers the front side of the lower guide base 54, curves down to the front end in line with the contour of the upper surface of the lower guide base 54, and the central portion, which covers the front part of the drum 31 nearly from the posterior part of the guide base 54, is generally flat, and the rear portion, which covers the back of the drum 31, curves down to the rear end in line with the contour of the drum 31. The upper guide base 62 is thus generally planer so as to bend in an anteroposterior direction.

The upper guide base 62 is arbitrarily provided with insertion holes or equivalent through which the upper tapes 34 and 35 are inserted.

In addition to that, in the vicinity of the rear end of the upper guide base 62, retraction holes 62A and 62B are cut in the lateral direction, into which inserted is the retraction shaft 64 put through the retraction holes 61F and 61G. That configuration allows the upper guide base 62 to rotate about the retraction shaft 64 functioning as its rotation axis in an open direction U1 or a close direction U2 with respect to the frame 61, FIG. 5.

To front upper part of the upper guide base 62, the pulley shaft 36 is fitted. In the pulley shaft 36, aside from the above-described upper tape pulleys 37 and 38, a lock lever 65 is rotatably inserted.

The lock lever 65 has an engagement groove 65A cut at its lower rear portion toward its forward portion, the groove having its width slightly greater than the outer diameter of the lock post 63. The rear portion of the lever 65 is formed into an inclined plane which decreases in lengthwise width toward the lower part which is below the engagement groove 65A.

The lock lever 65 has its upper part formed into an elongate detent 65B. When the serviceperson applies force on the front side of the detent 65B toward its back, the lock lever 65 is rotated about the pulley shaft 36 in an unlock direction V1. The lock lever 65 is biased by a spring, not shown, in a lock direction V2.

Thus, the lock lever 65 biased in the lock direction V2 is rotated to bring the engagement groove 65A into engagement with the lock post 63 of the frame 61, thereby uniting the frame 61 with the upper guide base 62 as illustrated in FIGS. 4 and 5.

During the above condition, the movable upper guide 51 can keep a state in which the under surface of the upper guide base 62 is brought close to the drum 31 and also to the upper surface of the lower guide base 54 so as to face the guide base 54 (this state will be called as closed state).

Furthermore, the lock lever 65 is rotated in the unlock direction V1 by an external force to thereby release the engagement of the engagement groove 65A with the lock post 63.

Figure 7:
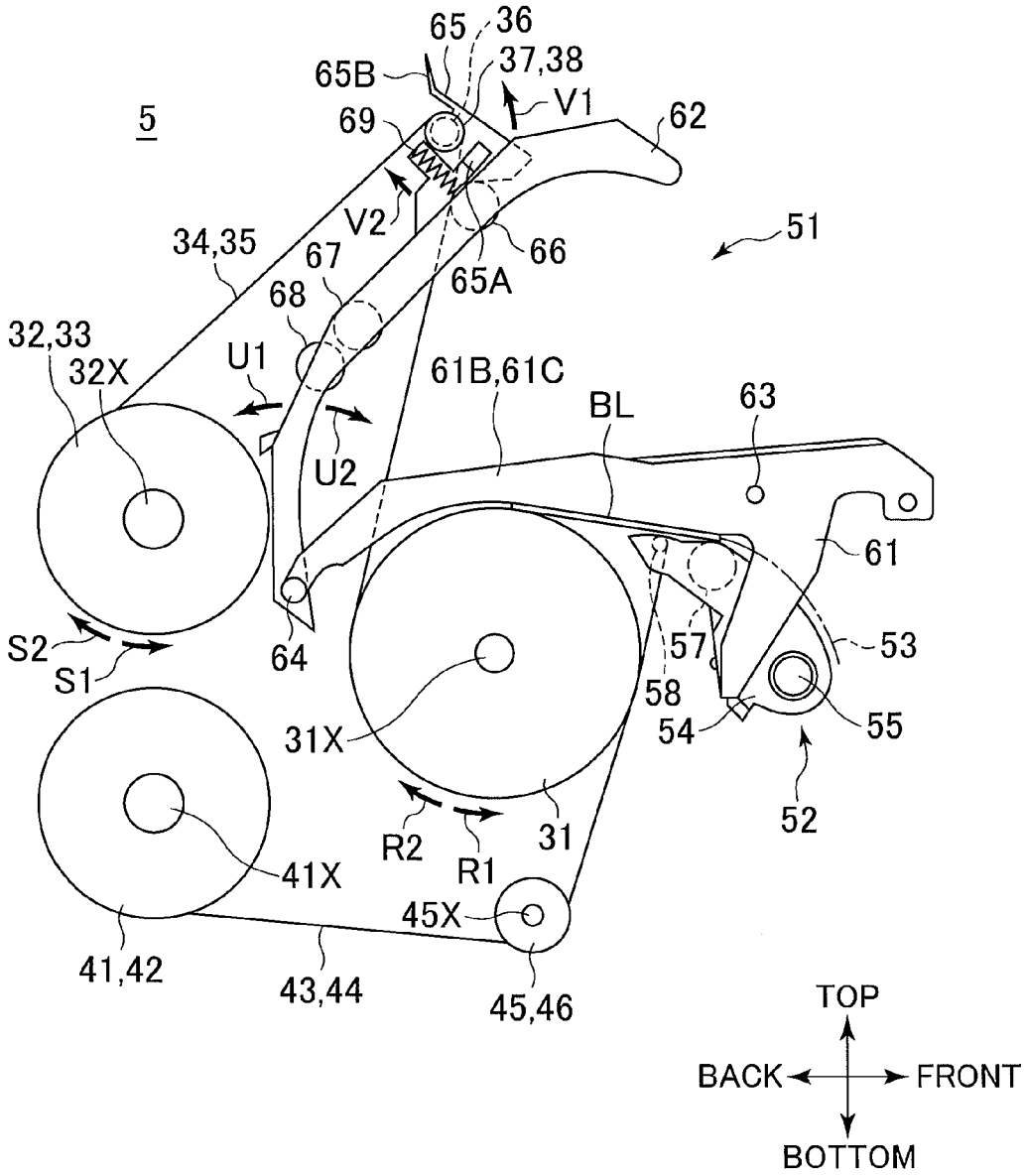
FIG. 7 is a schematic side view showing the preferred embodiment illustrated in FIG. 4 when the movable upper guide is raised.

When the engagement groove 65A of the lock lever 65 is disengaged from the lock post 63 and an external force acting upward is exerted on the front part, the upper guide base 62 rotates about the retraction shaft 64 in an open direction U1, as illustrated in FIGS. 6 and 7. In the following description, the state where the upper guide base 62 is rotated in the open direction U1 presented in FIGS. 6 and 7 will be referred to as open state.

When the upper guide base 62 in the open state is rotated in the close direction U2, the under surface of the guide base 62 moves closer to the drum 31 and the lower guide base 54, and the inclined plane formed on the underside of the lock lever 65 is brought into contact with the lock post 63, and the lock lever 65, which is biased in the lock direction V2, is thereby pushed up along the inclines plane of the lever 65 to rotate the lever in the unlock direction V1, thereby engaging the engagement groove 63A of the lover 65 with the lock post 63. Consequently, the upper guide base 62 is reunited with the frame 61 to come into the closed state again in which the under surface of the upper guide base 62 comes close to the drum 31 and the upper surface of the lower guide base 54.

In this way, the movable upper guide 51 is configured to rotate the upper guide base 62 about the retraction shaft 64 in the open direction U1 or the close direction U2 with respect to the frame 61 and keep the closed state by engaging the engagement groove 65A of the lock lever 65 with the lock post 63.

As shown in FIG. 7, the conveyance rollers 66, 67 and 68 are arranged such that the undersides of the rollers are exposed to the upper guide base 62. The rollers 66, 67 and 68 are cylindrical in form, and a rotation axis, not shown, penetrates through the rollers in the lateral direction to thereby allow the rollers to rotate in either direction.

The conveyance roller 66 is biased in a downward direction by means of a spring 69 which is compressed from its natural state. Thus, the conveyance roller 66 can, in the closed state, press bills BL conveyed over the conveyance path 53 against the conveyance roller 57, whereby the driving force of the conveyance roller 57 can be transmitted to the bills BL efficiently.

The conveyance roller 67 is positioned such that, in the closed state, it lies substantially immediately above, but slightly in front of, the drum 31 in the cross direction, i.e. adjacent to the front side of the conveyance roller 68, in between the upper reels 32 and 33 in the lateral direction, and the under surface of the roller 67 is in direct contact with the circumferential surface of the drum 31.

The conveyance roller 68 is positioned such that, in the closed state, it lies substantially immediately above the drum 31 in the cross direction, facing the upper reels 32 and 33 in the lateral direction, and the under surface of the roller 68 is in contact with the upper tapes 34 and 35. Accordingly, the conveyance roller 68 in the closed state brings bills BL, conveyed on the upper surfaces of the lower tapes 43 and 44 from the front side through the conveyance path 53, into contact with the upper tapes 34 and 35 to further convey the bills. More specifically, the conveyance roller 68 makes the bills BL to be nipped between the upper tapes 34, 35 and the lower tapes 43, 44 to send them backward to press the latter to the circumferential surface of the drum 31.

In this way, the movable guide 50 is arranged to convey, in the closed state, bills BL inserted into the bill insert/draw-out port 30C of the temporary holding housing 30 along the conveyance path 53, and sandwich the bills BL between upper tapes 34, 35 and the lower tapes 43, 44 to send them near the circumferential surface of the drum 31.

The movable guide 50 is configured to be rotatable about the rotation bore 55 of the movable lower guide 52 in the inward direction T1 or outward direction T2. With that configuration, since a force acts in the inward direction T1 due to gravity, part of the conveyance roller 67 exposing from the under surface of the upper guide base 62 is, in the closed state, pressed to come in contact with the circumferential surface of the drum 31. Consequently, when the drum 31 rotates in the winding direction R1, the conveyance roller 67 comes into direct contact with bills BL and presses them against the circumferential surface of the drum 31, and the movable guide 50 can thereby guide the bills BL in such a manner that the bills, which are only partly held between the upper tapes 34, 35 and the lower tapes 43, 44, are pressed against the circumferential surface of the drum 31 while they are unbent and smoothed out in their long-side, or lateral, direction.

As a lot of bills BL are sequentially wound on the drum 31, the drum 31 has its apparent outer diameter increased. Correspondingly, the upper guide base 62 is gradually lifted upward by the drum 31 so as to turn the movable guide 50 about the rotation bore 55 in the outward direction T2, FIG. 5. That is to say, regardless of how the outer diameter of the drum 31 is, the movable guide 50 can bring part of the conveyance roller 67 exposing from the under surface of the upper guide base 62 into contact with the drum 31 to thereby make the conveyance direction of the bills BL to follow the outer circumferential surface of the drum 31.

In addition, regardless of how the outer diameter of the drum 31 is, the movable guide 50 can continuously cover, in the closed state, the open area 30B of the temporary holding housing 30 from above the drum 31 so as to block up the internal space 30A from outside.

In the illustrative embodiment, the conditions of the temporary holding section 5 are optimized with regard to, e.g. the outer diameter of the drum 31, the space between the drum 31 and the temporary holding housing 30, the lengths of the upper tape 34, 35 and the lower tapes 43, 44, so that about two hundreds of bills BL can continuously be wound on the drum 31.

The above-described configuration can produce the following advantages.

In the temporary holding section 5 according to the first embodiment, the upper guide base 62 is rotatably connected to the frame 61 by the retraction shaft 64 in the vicinity of the rear end of the movable upper guide 51 and an engagement of the engagement groove 65A of the lock lever 65 with the lock post 63 in the front side causes the closed state shown in FIGS. 4 and 5 to be retained in which the under surface of the upper guide base 62 is moved closer to the drum 31 so as to oppose to the upper surface of the lower guide base 54.

Simultaneously, the temporary holding section 5 can cover the open area 30B of the temporary holding housing 30 from above the drum 31 by means of the upper guide base 62 to block up the internal space 30A from outside.

As a consequence, the temporary holding section 5 can hold bills BL and torn bills BX inside the internal space 30A without improperly discharging the bills outside, and also prevent any foreign matters from getting inside.

In addition, in the closed state, as the movable upper guide 51 presses the conveyance rollers 66 and 68 against the conveyance roller 57 of the movable lower guide 52 and the drum 31, the movable guide 50 can transmit the driving force of the conveyance roller 57 efficiently to bills BL running on the conveyance path 53.

Furthermore, when the serviceperson applies an external force in the backward direction on the detent 65B, the lock lever 65 is rotated about the pulley shaft 36 in the unlock direction V1 to disengage the engagement groove 65A from the lock post 63 of the frame 61. Moreover, when the external force in the upward direction is exerted on the front side of the upper guide base 62 via the lock lever 65 or equivalent, the guide base 62 rotates about the retraction shaft 64 in the open direction U1 to bring about the open state in which the under surface of the upper guide base 62 is moved away from the drum 31 and the upper surface of the lower guide base 54.

In the open state, the internal space 30A in the temporary holding housing 30 of the temporary holding section 5 communicates with outside, so that the serviceperson can easily views the internal space 30A, the drum 31 and the others from the outside and easily insert the tools and his/her fingers inside, that is, it is easy to get access to the internal space.

Moreover, in the open state, the upper surface of the lower guide base 54 is exposed outside, which means the conveyance path 53 can be wide opened. Thus, it becomes much easier than ever to carry out the maintenance work on the conveyance path 53, which is rather higher in possibility of jamming of bills BL being conveyed than the other parts of the temporary holding section 5.

In the above case, the upper guide base 62 rotates together with the pulley shaft 36 fitted to the base 62 in the open direction U1, thereby lifting up the upper tape pulleys 37 and 38 inserted in the pulley shaft 36 in a posterosuperior direction.

As a result, the upper guide base 62 also moves the upper tapes 34 and 35 running on the upper tape pulleys 37 and 38 in the posterosuperior direction, so that the extent that the tapes 34 and 35 run across the open area 30B in the anteroposterior direction can be decreased.

In other words, a simple rotation of the upper guide base 62 in the open direction U1 can draw backward the upper tapes 34 and 35, otherwise running across the open area 30B, to retract the tapes from the open area 30B, thereby further enhancing the workability when the serviceperson gets access via the open area 30B to the inner positions such as the internal space 30A and the drum 31.

In this connection, since the rotation of the upper guide base 62 in the open direction U1 reduces the length along which the upper tapes 34 and 35 run from the upper reels 32 and 33 to turn around the upper tape pulleys 37 and 38 to the drum 31, the upper tapes 34 and 35 would significantly slack in the open state.

However, since a force is applied, as described above, on the upper reels 32 and 33 in the winding direction S1 by a torsion spring, not shown, the upper reels 32 and 33 are rotated in the winding direction S1 to take up the upper tapes 34 and 35 appropriately so that the slack in the upper tapes 34 and 35 can automatically be removed.

The above configuration can prevent secondary difficulties from being caused, such as the cutoff of the upper tape 34 or 35 caused by the serviceperson getting inadvertently the tools or fingers caught in the slacked upper tape 34 or 35, or another jam of bills caused by rotating the drum 31 unintentionally.

In this way, the temporary holding section 5 simply permits the serviceperson to do an easy operation of releasing the locking by the lock lever 65 to rotate the upper guide base 62 in the open direction U1, whereby the open area 30B can be opened widely and the upper tapes 34 and 35 can be retracted to eliminate the slack in the tapes. Thus, better maintenance work environment can be established than ever before.

When the upper guide base 62 rotates in the close direction U2, the lock lever 65 rotates in the unlock direction V1 while sliding the inclined plane formed on the lower side of the lock lever 65 on the lock post 63, and then the engagement groove 65A engages with the lock post 63, the temporary holding section 5 thereby retaining the closed state.

In this case, the upper reels 32 and 33 are rotated in a drawing direction S2 by the torsion spring, not shown, to draw out the upper tapes 34 and 35, whereby the tension of the upper tapes 34 and 35 can be maintained properly.

More specifically, the temporary holding section 5 can switch back from the open state to the closed state by simply rotating the upper guide base 62 by the serviceperson in the closed direction U2 to engage the engagement groove 65A of the lock lever 65 with the lock post 63, whereupon the upper tapes 34 and 35 can return to the initial state in which the tapes lie along the initial running path under proper tension.

The temporary holding section 5 is thus configured to allow the upper guide base 62 to be rotated by means of the retraction shaft 64 mounted on the rear side of the movable upper guide 51 to engage the engagement groove 65A of the lock lever 65 with the lock post 63 to retain the closed state. The temporary holding section 5 is also arranged such that, when the lock lever 65 is rotated in the unlock direction V1, the engagement groove 65A is disengaged from the lock post 63, and then the upper guide base 62 rotates in the open direction U1 by receiving the external force acting in the upward direction to shift itself into the open state.

Now, a second embodiment of the invention will be described. An automated teller machine 101 in the second embodiment has a configuration similar to that of the automated teller machine in the first embodiment except that the automated teller machine 101 has a temporary holding section 105 instead of the temporary holding section 5 in the first embodiment.

The temporary holding section 105 is different from the temporary holding section 5 of the first embodiment in that the section 105 employs a movable guide 150 in place of the movable guide 50, but has the same configuration in terms of the running system of the tapes, the drum 31 and others.

The movable guide 150 is different from the movable guide 50 in that the movable guide 150 has a movable upper guide 151 instead of the movable upper guide 51, but has the same configuration concerning the movable lower guide 52 and the conveyance path 53.

Figure 8:
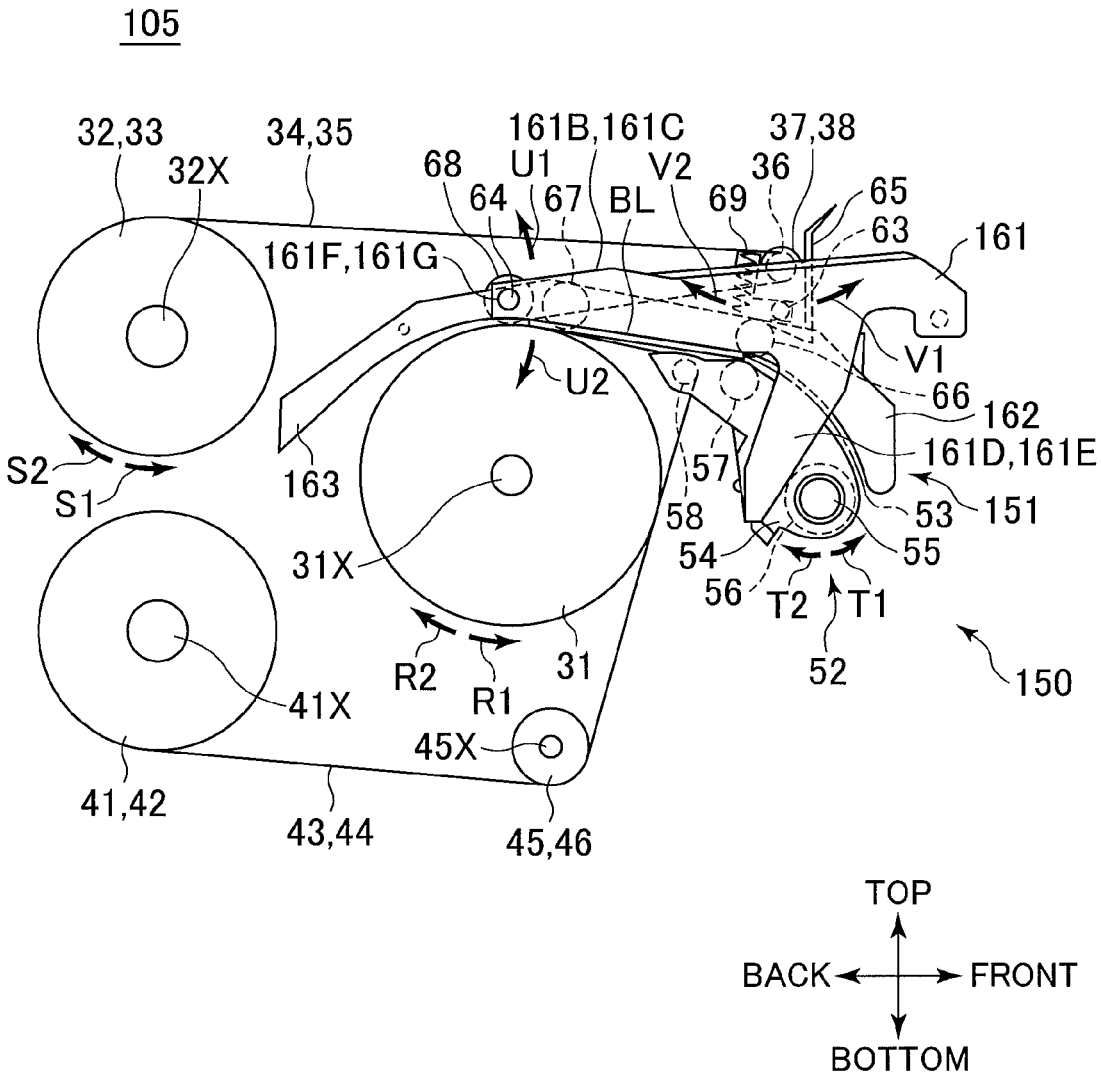
FIG. 8 is a schematic side view showing the internal structure of the temporary holding section in an alternative embodiment of the present invention.

The movable upper guide 151 is different from the movable upper guide 51, as shown in FIG. 8, in that a frame 161 is provided instead of the frame 61 and an upper guide base 162 and an upper drum guide 163 are provided in place of the upper guide base 62. In regard to the other elements, the guide 151 has the configuration similar to that of the guide 51.

The frame 161 is configured differently from the frame 61 in that a left and a right arm 161B and 161C are arranged to extend backward from the respective left and right ends of an anterior part 161A, which elongates in the lateral direction on the front side of the frame 161, to the vicinity of a point where the upper guide base 162 abuts on the drum 31, i.e. where the conveyance roller 68 is provided, and the left and right arms 61B and 61C extend backward shorter than the arms 61B and 61C.

Moreover, in the vicinity of the rear ends of the left and right arms 161B and 161*c*, i.e. near the place where the upper guide base 162 comes into contact with the drum 31, retraction holes 161F and 161G are cut to penetrate through the respective arms in the lateral direction, and inserted into the retraction holes 161F and 161G is a retraction shaft 64 having a cylindrical shape in the lateral direction, as in the case with the retraction holes 61F and 61G in the first embodiment.

The upper guide base 162 is composed of portions equivalent to the median and front parts of the upper guide base 62 in the first embodiment, and the rear part of the upper guide base 162, which is close to the upper area of the place contacting with the drum 31, is provided with retraction holes 162A and 162B which penetrate through the guide base 162 in the lateral direction.

In the retraction holes 162A and 162B, the retraction shaft 64 is inserted together with the retraction holes 161F and 161G of the frame 161. That configuration allows the upper guide base 162 to rotate about the retraction shaft 64 serving as its rotation axis in the open direction U1 or close direction U2 with respect to the frame 161.

The upper drum guide 163 is equivalent to the rear part of the upper guide base 62 in the first embodiment, and is attached to the rear ends of the left and right arms 161B and 161C of the frame 161 and fixed to the frame 161.

Figure 9:
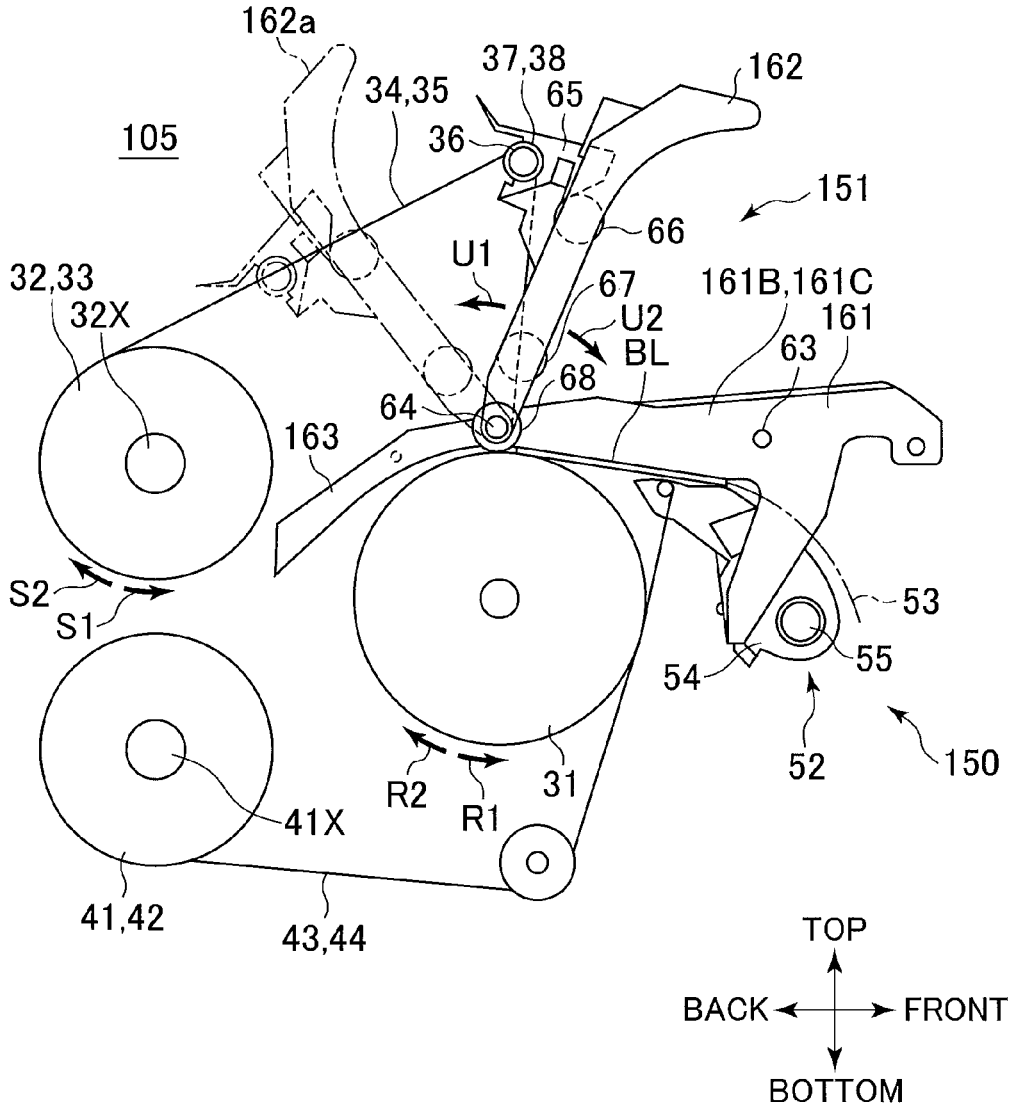
FIG. 9 is a schematic side view showing the alternative embodiment shown in FIG. 8 when its movable upper guide is raised.

Specifically, the movable upper guide 151 of the second embodiment is arranged so that, as illustrated in FIG. 9, the upper guide base 162 lying anterior to the place contacting with the drum 31 can rotate in the open direction U1 with the upper drum guide 163 retained.

Furthermore, the upper guide base 162 is provided with the conveyance rollers 66, 67 and 68 on its under surface as with the upper guide base 62, and above the front side of the guide base 162 the pulley shaft 36, the upper tape pulleys 37, 38 and the lock lever 65 are fitted.

The above configuration can produce the following advantages.

In the temporary holding section 105 according to the second embodiment, the frame 161 and the upper guide base 162 are rotatably joined by the retraction shaft 64 in the vicinity of the upper part of the place where the movable upper guide 151 comes in contact with the drum 31, and as in the case with the first embodiment, the engagement groove 65A of the lock lever 65 is rendered in engagement with the lock post 63, thereby maintaining the closed state, shown in FIG. 8, in which the under surface of the upper guide base 162 is brought close to the drum 31 and faces the upper surface of the lower guide base 54.

The temporary holding section 105 can as well cover the open area 30B of the temporary holding housing 30 from above the drum 31 by utilizing the upper guide base 162 and the upper drum guide 163, so that the internal space 30A can be block up from outside.

Furthermore, when the serviceperson rotates the lock lever 65 in the unlock direction V1, the upper guide base 162 disengages the engagement groove 65A from the lock post 63. Then, the upper guide base 162 rotates, upon receipt of an external force acting in the upward direction, about the retraction shaft 64 in the open direction U1 to thereby change into the open state, shown in FIG. 9, in which the under surface of the upper guide base 162 is moved away from the drum 31 and the upper surface of the lower guide base 54.

In the open state, the internal space 30A in the temporary holding housing 30 of the temporary holding section 105 communicates with outside, so that the serviceperson can easily view the internal space 30A, the drum 31 and the others from the outside and easily insert the tools and his/her fingers thereinside, that is, it is easy to get access to the internal space.

In this case, as in the case of the first embodiment, the upper guide base 162 can draw backward the upper tapes 34 and 35, otherwise running across the open area 30B, to retract the tapes from the open area 30B.

Moreover, the upper reels 32 and 33 can be rotated in the winding direction S1 by the torsion spring, not shown, to take up the upper tapes 34 and 35 appropriately, thereby automatically removing the slack in the upper tapes 34 and 35.

Well, in the first embodiment, the configuration of the temporary holding section 5 regarding the shape of the upper guide base 62, the position of the retraction shaft 64 and the upper reels 32 and 33, or the inner aspect of the temporary holding housing 30 allows the upper guide base 62 to rotate in the open direction U1 at angles up to 45 degrees (FIG. 7).

As to the temporary holding section 105 in the second embodiment, the retraction shaft 64 is fitted nearly above the drum 31, and the upper drum guide 163 is not provided with any components thereabove. Thus, as shown in FIG. 9 with two-dotted chain line, the upper guide base 162 can be rotated at larger angles up to about 120 degrees.

Consequently, in the temporary holding section 105, space equivalent to the area of the upper surface of the lower guide base 54 and above the front side of the drum 31 in the open area 30B can completely be opened, thereby facilitating the serviceperson in visually inspecting, and accessing to, the internal space 30A from above.

Moreover, the under surface of the upper guide base 162 in the temporary holding section 5, i.e. the plane constituting the conveyance path 3 between the under surface and the lower guide base 54 in the closed state, can be pointed toward the front or upward, so that the workability in connection with the upper guide base 162 will be increased.

In regard to the aspects other than the above also, the temporary holding section 105 in the second embodiment can attain the same effects as the temporary holding section 5 in the first embodiment.

The temporary holding section 105 thus configured allows the upper guide base 162 to be rotated by means of the retraction shaft 64 lying posterior to the center of the movable upper guide 151 so as to engage the engagement groove 65A of the lock lever 65 with the lock post 63 to retain the closed state. The temporary holding section 105 is also arranged such that, when the lock lever 65 is rotated in the unlock direction V1, the engagement groove 65A is disengaged from the lock post 63, and then the upper guide base 162 rotates in the open direction U1 upon receipt of the external force acting in the upward direction to thereby change into the open state.

It is noted that the retraction shaft 64 is attached, in the first embodiment, near the rear end of the movable upper guide 51, and, in the second embodiment, substantially right above the drum 31 so as to rotatably connect the upper guide base 62 or 162 to the frame 61 or 161, respectively.

The present invention may, however, not be restricted thereto, but the retraction shaft 64 can be attached on any part on the movable upper guide so that the upper guide base may be rotatably connected to the frame at a position ahead of the connecting position. In that case, the pulley shaft 36 is adapted to be rotatable along with the upper guide base to move the upper tapes 34 and 35 respectively wound on the upper tape pulleys 37 and 38 together at least in the backward direction.

In the first and second embodiments, the upper guide base is adapted to rotate about a single rotation axis consisting of the retraction shaft 64. The present invention is, however, not limited thereto, but may use two or more rotation axes in such a way that those axes are rotated to open and close the upper guide base.

Figure 10:
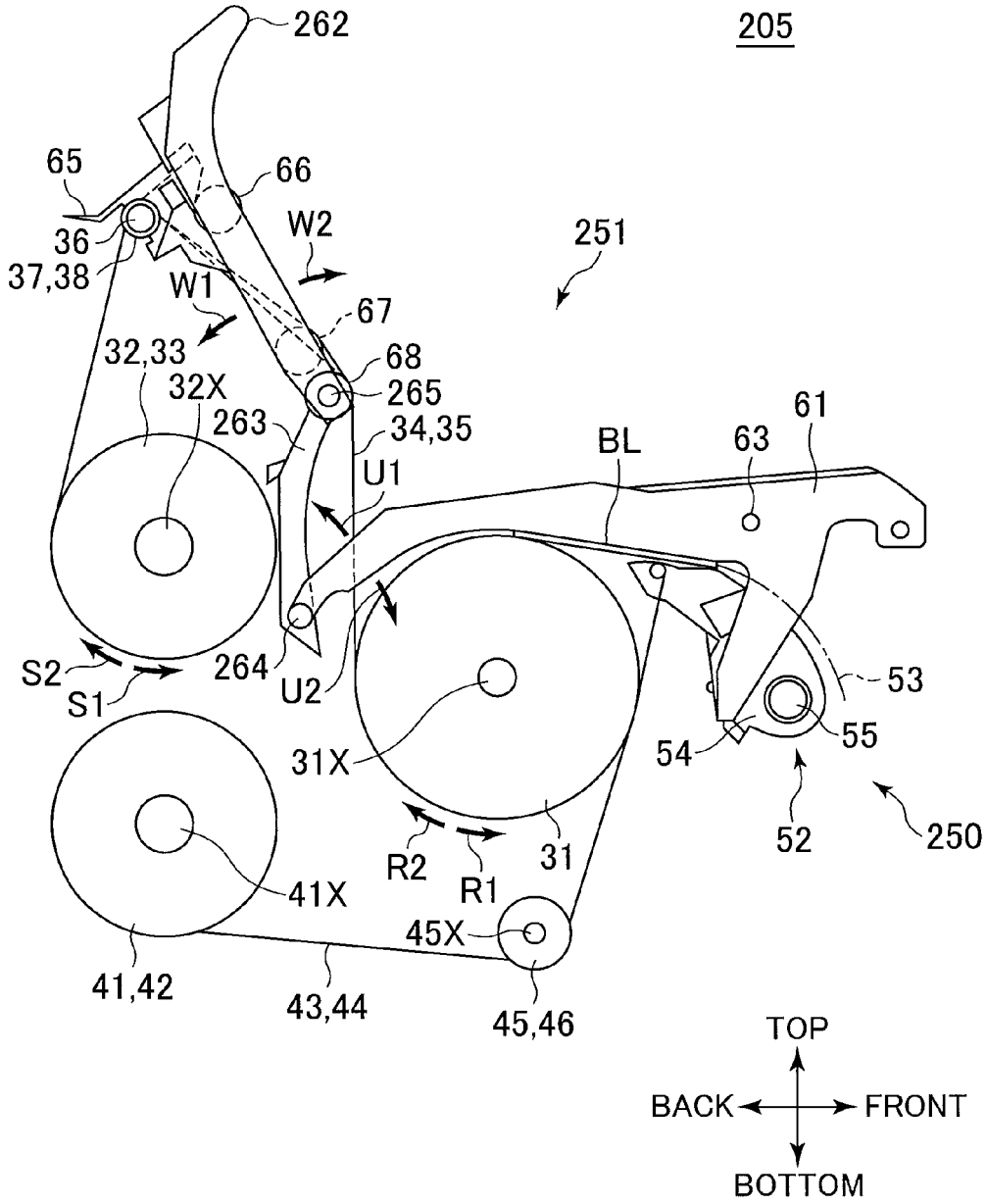
FIG. 10 is a schematic side view showing the internal structure of the temporary holding section in a further alternative embodiment of the present invention.

For example, as shown in FIG. 10, a temporary holding section 205 has a movable guide 250 corresponding to the movable guide 150, the movable guide 250 including a movable upper guide 251 corresponding to the movable upper guide 151. The movable upper guide 251 has the same frame 61 as the first embodiment, and also an upper guide base 262 and an upper drum guide 263 similar to those of the second embodiment.

The upper drum guide 263 is, as with the upper guide base 62 in the first embodiment, jointed rotatably by a retraction shaft 264 at the back ends of the left and right arms 61B and 61C of the frame 61. Moreover, the upper guide base 262 is rotatably jointed at its rear end to the front end of the upper drum guide 263 by a retraction shaft 265.

More specifically, the temporary holding section 205 is adapted to rotate the upper drum guide 263 about the retraction shaft 264 in the open direction U1 or close direction U2 with respect to the frame 61, and also rotate the upper guide base 262 about the retraction shaft 265 in an open direction W1 or close direction W2 with respect to the upper drum guide 263.

With the above configuration, the temporary holding section 205 can open wide the upper parts of the drum 31 and the lower guide base 54 as shown in FIG. 10, and furthermore can enhance the visibility and the workability relating to the upper guide base 262.

Moreover in that case, an alternative configuration can be adopted in which the upper drum guide 263 is formed of flexible material, such as rubber or resin with the retraction shaft omitted, so that bending the upper guide drum 263 renders the state change between the closed and open states.

In addition to that, the first and second embodiments have the configuration in which the retraction shaft 64 is inserted through the retraction holes 62A, 62B or 162, 162B of the upper guide base 62 or 162 as well as the retraction holes 61F, 61G of the frame 61 so as to be rendered as rotation axis, but the present invention may not be restricted thereto. By way of example, a cylindrical rotation axis may be formed on the opposite sides of the upper guide base 62 or 162 to project outward, and is inserted in the retraction holes 61F and 61G of the frame 61 so as to act as rotation axis.

In the first and second embodiments, the rotational action of the retraction shaft 64 is utilized to change the state of the upper guide base 62 or 162 between the open and closed states. The present invention is however not limited thereto, but the upper guide base can shift itself from the open to closed state and vice versa by utilizing a known mechanism, such as slide or link mechanism. In that case also, the upper guide base is slid integrally with the pulley shaft 36 to move the upper tapes 34 and 35 wound on the upper tape pulleys 37 and 38 together at least in the backward direction, so that the extent that the tapes 34 and 35 run across the open area 30B in the anteroposterior direction can be decreased.

In the first and second embodiments further, the pulley shaft 36 with the upper tape pulleys 37 and 38 inserted therein is fixed on the upper guide base 62 or 162 to allow the upper tape pulley 37 and 38 to move in the posterosuperior direction as the upper guide base 62 or 162 rotates. The present invention may not be restrictive thereto. The pulley shaft 36 can be attached in a certain movement mechanism so that the movement mechanism moves as the upper guide base 62 or 162 rotates. That is, in the open state, the upper tape pulleys 37 and 38 are moved together with the pulley shaft 36 in backward where the upper reels 32 and 33 are disposed so as to be able to move the upper tapes 34 and 35 away from the open area 30B.

Further in the first and second embodiments, the engagement groove 65A of the lock lever 65 is used as a lock mechanism for engaging with the lock post 63 to integrate the upper guide base 62 or 162 with the frame 61 or 161, respectively, to keep the closed state, or to unlock to switch into the open state. The present invention is however not restricted thereto, but for instance, lock pins, which are enabled outwardly by springs or equivalent, may be attached on and protruded from the right and left sides of the upper guide base 62 or 162 and holes may also be formed in the right and left internal faces of the frame 61 or 161. In that case, the lock pins are engaged with the holes to retain the closed state or pulled inward via a release lever to unlock and bring the upper guide base to the open state.

The present invention can employ various known lock mechanisms other than the above so long as the upper guide base can be locked or secured to the frame to go into the closed state and unlocked to go into the open state.

In the first and second embodiments, the torsion spring not shown in the figures is used for biasing the upper reels 32 and 33 in the winding direction S1 to take up the upper tapes 34 and 35 in the open state to thereby remove the slacks in the tapes. The present invention may not be limited thereto. The torque of a motor not shown in the figures may be arranged to be transmitted to the upper reels 32 and 33 so that, when the upper guide base is rotated in the open direction U1, the motor is run automatically or manually to rotate the upper reels 32 and 33 in the winding direction S1 to remove the slacks in the upper tapes 34 and 35.

The first and second embodiments have the configuration in which the temporary holding section 5 is provided on its right and left sides with two pairs of tape-running systems including the upper tapes 34 and 35 and the lower tapes 43 and 44 in combination. The present invention may not be limitative thereto. The temporary holding section 5 may have one pair or more than two pairs of tape-running systems.

Furthermore, the first and second embodiments have the configuration in which the temporary holding section 5 or 105 holds bills BL between the upper tapes 34, 35 and the lower tapes 43, 44 and wraps the bills BL around the outer circumferential surface of the drum 31. The present invention is, however, not limited thereto, but alternatively may be of a configuration in which the upper tapes 34 and 35 may have adhesion on their surfaces with which bills BL come into contact for temporarily sticking the bills BL with the adhesion onto the upper tapes 34 and 35, and the upper tapes 34 and 35 are wrapped around the outer circumferential surface of the drum 31 to overlay on the outer circumferential side of the bills BL, whereby the mechanism associated with the lower tapes 43 and 44 can be eliminated from the temporary holding section 5 or 105.

The temporary holding section 5 or 105 in the first or second embodiment is designed to temporarily hold bills deposited to the automated teller machine 1 during the deposit transaction. The present invention is, however, not restricted to the above, but can be applied to various machines and apparatuses, such as an apparatus dedicated to authenticating or counting bills, for sandwiching bills BL by the upper tapes 34, 35 and the lower tapes 43, 44 to wrap them on the drum 31 for temporary storage.

The first and second embodiment are directed to the temporary holding section 5 or 105 of the automated teller machine 1 or 101 for cash transaction that holds bills BL as media in such a way that the bills are conveyed between the upper tapes 34, 35 and the lower tapes 43, 44 and wound around the drum 31. However, the present invention may be limitative thereto, but applied to various machines and apparatuses which hold thin strip-like media, such as admission tickets. In such a case, the widths of the upper tapes 34, 35 and the lower tapes 43, 44 can be designed appropriately according to the size and shape of the media.

Furthermore, in the first and second embodiments, the temporary holding section 5 or 105 is composed, as a medium stocking apparatus, of the temporary holding housing 30 as a housing, the upper reels 32 and 33 as reels, the upper tape pulleys 37 and 38 as a diverting unit, the drum 31 as a drum, the movable upper guide 51 or 151 as a winding guide, the upper guide base 62 or 162 as an openable unit and the retraction shaft 64. The present invention is not, however, restricted thereto, but may consist of a housing, reels, a diverting unit, a drum, a winding guide and an openable unit, all of which are configured differently from the above-described configurations.

Moreover, in the first and second embodiments, the automated teller machine 1 or 101 as a medium stocking apparatus is composed of the customer service section 3 as an receiving section, the conveyance path 7 as a conveyance section, the temporary holding housing 30 as a housing, the upper reels 32 and 33 as reels, the upper tape pulleys 37 and 38 as a diverting unit, the drum 31 as a drum, the movable upper guide 51 or 151 as a winding guide, the upper guide base 62 or 162 as an openable unit and the retraction shaft 64. However, the present invention is not restricted thereto, but may consist of a receiving section, a conveyance section, a housing, reels, a diverting unit, a drum, a winding guide and an openable unit, all of which are configured differently from the above-described configurations.

The entire disclosure of Japanese patent application No. 2011-162420 filed on Jul. 25, 2011, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A medium stocking apparatus comprising:

a housing forming an internal space surrounded by a partition and having an open area where a part of the partition is eliminated;

a reel on which a tape is wound which is generally rectangular and has a width narrower than a long side of a medium;

a diverting unit arranged on a side opposite to said reel across the open area for diverting the tape drawn out from said reel and running across the open area;

a cylindrical drum disposed rotatably in the internal space with respect to said housing for winding thereon the tape diverted by said diverting unit with the medium, when fed from outside of said housing in its narrow-side direction, overlaid on the tape;

a winding guide blocking up the internal space from the outside at the open area for guiding the tape and the medium diverted by said diverting unit along a running path toward a circumferential surface of said drum; and an openable unit, which is a part of said winding guide, for closing and opening the internal space from and to the outside and narrowing an extent that the tape, which is drawn out from said reel and runs across the open area, blocks off the open area in an open state in comparison with that in a closed state.

2. The medium stocking apparatus in accordance with claim 1, wherein said openable unit brings said diverting unit closer to said reel in the open state than in the closed state.

3. The medium stocking apparatus in accordance with claim 1, wherein said diverting unit is attached to said winding guide movably in response to an open/close movement of said openable unit.

4. The medium stocking apparatus in accordance with claim 1, wherein said winding guide comprises a lower guide including a portion of the running path on a side of said drum, and an upper guide having a running portion opposed to said lower guide across the running path and a portion of a circumferential side facing the circumferential surface of said drum, said openable unit separating, in the open state, at least the running portion of said upper guide from said lower guide.

5. The medium stocking apparatus in accordance with claim 4, wherein said openable unit separates, in the open state, the running portion of said upper guide from said lower guide and the portion on the circumferential side from the circumferential surface of said drum.

6. The medium stocking apparatus in accordance with claim 1, wherein said openable unit rotates a part of said winding guide about a rotation axis substantially parallel with a rotation axis of said drum to thereby close or open up the internal space from or to the outside.

7. The medium stocking apparatus in accordance with claim 1, further comprising a remittent adjuster reducing or eliminating a slack in the tape when said openable unit is opened up.

8. A medium transaction apparatus comprising:

a receiving section receiving a transaction of a generally rectangular medium;

a conveyance section conveying the medium received by said receiving section;

a housing forming an internal space surrounded by a partition and having an open area where a part of the partition is eliminated;

a reel on which a tape is wound which has a width narrower than a long side of the medium;

a diverting unit arranged on a side opposite to said reel across the open area for diverting the tape drawn out from said reel and running across the open area;

a cylindrical drum disposed rotatably in the internal space with respect to said housing for winding thereon the tape diverted by said diverting unit with the medium, when fed from the conveyance section in its narrow-side direction, overlaid on the tape;

a winding guide blocking up the internal space from an outside of the housing at the open area for guiding the tape and the medium diverted by said diverting unit along a running path toward a circumferential surface of said drum; and an openable unit, which is a part of said winding guide, for closing and opening the internal space from and to the outside of the housing and narrowing an extent that the tape, which is draw out from said reel and runs across the open area, blocks off the open area in an open state in comparison with that in a closed state.

* * * * *